US007712634B2

(12) United States Patent
MacMichael et al.

(10) Patent No.: US 7,712,634 B2
(45) Date of Patent: May 11, 2010

(54) APPARATUS AND METHOD FOR DISPENSING SMALL QUANTITIES OF PARTICLES

(75) Inventors: Donald Bruce Atherton MacMichael, Ickleford (GB); William Robert Charles Opie, Bonn-Bevel (DE); Simon Mark Bryant, Hertford (GB); Imogen Gill, Nr. Royston (GB)

(73) Assignee: Pfizer Limited, Sandwich, Kent (GB)

( * ) Notice: Subject to any disclaimer, the term of this patent is extended or adjusted under 35 U.S.C. 154(b) by 1687 days.

(21) Appl. No.: 10/490,686

(22) PCT Filed: Sep. 20, 2002

(86) PCT No.: PCT/GB02/04281

§ 371 (c)(1),
(2), (4) Date: Jun. 24, 2004

(87) PCT Pub. No.: WO03/026965

PCT Pub. Date: Apr. 3, 2003

(65) Prior Publication Data

US 2004/0238561 A1 Dec. 2, 2004

(30) Foreign Application Priority Data

Sep. 24, 2001 (GB) ..... 0122935.0

(51) Int. Cl.
*B65D 88/66* (2006.01)

(52) U.S. Cl. ..... 222/198; 222/1; 222/161; 222/181.1; 222/189.11; 222/196

(58) Field of Classification Search ..... 222/1, 222/197–200, 52, 63, 181.1, 181.2, 185.1, 222/189.06, 189.07, 189.11, 160–162, 196
See application file for complete search history.

(56) References Cited

U.S. PATENT DOCUMENTS

| | | | | |
|---|---|---|---|---|
| 1,712,235 | A | 5/1929 | Small | |
| 2,246,497 | A | 6/1941 | Beck | |
| 2,573,315 | A | 10/1951 | Dericks | |
| 2,676,733 | A | 4/1954 | Lober | |
| 2,742,184 | A * | 4/1956 | Yerkes et al. | 221/203 |

(Continued)

FOREIGN PATENT DOCUMENTS

| | | |
|---|---|---|
| AU | 5330609 B | 12/1983 |

(Continued)

*Primary Examiner*—Frederick C. Nicolas
(74) *Attorney, Agent, or Firm*—Hamilton, Brook, Smith & Reynolds, P.C.

(57) ABSTRACT

An apparatus for dispensing small quantities of particles, the apparatus comprises a hopper provided with a sieve at a bottom portion thereof, the hopper in use containing powder to be dispensed therefrom through the sieve, a support for the hopper, the support holding a portion of the hopper so that the hopper can in use be held above a container into which the dispensed powder is to be received, and at least one actuator for delivering impact energy to the hopper for causing powder to be dispensed through the sieve when the hopper receives the impact energy, wherein the at least one actuator is arranged to deliver impact energy to the hopper from different directions and/or at different locations on the hopper. There is also provided a method of dispensing small quantities of particles.

20 Claims, 2 Drawing Sheets

U.S. PATENT DOCUMENTS

| | | | | |
|---|---|---|---|---|
| 3,179,302 | A | 4/1965 | Murray | |
| 3,353,572 | A | 11/1967 | Anderson et al. | |
| 3,791,558 | A | 2/1974 | Katusha | |
| 4,083,475 | A | 4/1978 | Venner et al. | |
| 4,188,907 | A | 2/1980 | Lipani | |
| 4,206,714 | A * | 6/1980 | Walsh | 111/92 |
| 4,378,078 | A | 3/1983 | Daniels | |
| 4,684,041 | A | 8/1987 | Jones et al. | |
| 5,215,228 | A | 6/1993 | Andrews et al. | |
| 5,685,348 | A | 11/1997 | Wegman et al. | |
| 6,471,096 | B1 | 10/2002 | Dave | |
| 2004/0045979 | A1 * | 3/2004 | Macmichael | 222/1 |

FOREIGN PATENT DOCUMENTS

| | | | |
|---|---|---|---|
| EP | O 225 836 | A1 | 6/1987 |
| FR | 1 281 992 | A | 1/1962 |
| GB | 986 559 | A | 3/1965 |
| GB | 2 185 242 | A | 7/1987 |
| GB | 2306950 | A | 5/1997 |
| WO | WO 01/33176 | | 5/2001 |
| WO | WO 2006003379 | A1 * | 1/2006 |

* cited by examiner

APPARATUS AND METHOD FOR DISPENSING SMALL QUANTITIES OF PARTICLES

RELATED APPLICATIONS

This application is the U.S. National Stage of International Application No. PCT/GB02/04281, filed 20 Sep. 2002, published in English, which application claims priority under 35 U.S.C. §119 or 365 to Great Britain Application No. 0122935.0, filed 24 Sep. 2001, the entire teachings of the above referenced applications are incorporated herein by reference.

The present invention relates to an apparatus and method for dispensing small quantities of particles.

The flow characteristics of powders have a tendency to prevent flow of the powder through small holes, for example in a sieve containing the powder, under the action of gravity because the powder particles tend to agglomerate into larger particles However it is well known that shaking the hopper causes the powder to flow. It has been shown that applying discrete movements of a well defined nature to the hopper can cause a reproducible amount of powder to flow through the holes.

For example, WO-A-01/33176 discloses an apparatus and method for dispensing small quantities of particles, in particular small amounts of medicament especially in a powder form. The apparatus uses a funnel shaped hopper with a plurality of holes in a membrane at the base of the hopper, forming a sieve-like element, through which powder present in the hopper may fall. A preferred method is to tap the hopper horizontally to cause such a movement, thereby controllably dispensing powder through the membrane. The tapping is achieved by an electro-mechanical actuator which delivers impact energy to the hopper, which in turn causes a small number of particles to fall through the sieve-like element and onto a weighing measuring balance. The actuator is a horizontally oriented solenoid which taps the side of the hopper via a rod which supports the hopper at one end and has the solenoid mounted at the other end. A tapping action can also be done with a vertical component to the action of the actuator or the resultant movement of the hopper.

FIG. 1 shows schematically the dispensing head of a precision powder metering system as described in WO-A-01/33176.

Referring to FIG. 1, the device consists of a hopper 1 for a powder material, for example a medicament used for administration to the lungs of a patient via a powder inhaler. The hopper 1 is of generally frusto-conical form with the larger end 2 open and uppermost. The smaller end 3 is closed by a plate 4 in which a plurality of holes 5 are formed, thereby forming a sieve. When a powder 7 is placed in the hopper 1, some powder 7 may initially fall through the holes 5 but thereafter, in general, the powder flow stops as the powder 7 jams in the holes 5. The flow of powder 7 through the holes 5 can be made controllable and reproducible by the choice of appropriate dimensions for the holes to match the properties of the powder. Typically, the holes lie in the range of from 10 microns to 1000 microns.

In order to use the apparatus for precision dispensing, a receptacle 8 for the powder 7 is placed under the plate 4 and the hopper 1 is tapped on the sidewall 9 thereof at a location 6. The tap may be in a form that results from the impact of a mass travelling at a controlled velocity. The resulting motion of the hopper 1 and powder 7 causes the powder 7 to flow through the holes 5 in the plate 4 for a small period of time following the impact, after which the powder flow stops. Thus a discrete amount of powder 7 is controllably dispensed into the receptacle 8 as a result of each tap.

In order to accurately dispense a desired total amount of the powder 7, a plurality of taps are used to fill each receptacle 8 and the total weight of powder 7 dispensed into the receptacle 8 is measured in real time so that as soon as the required amount has been dispensed, the tapping can be stopped.

This arrangement however results in the movement of the bulk powder 7 remaining in the hopper 1 as shown in FIG. 2. It has been observed that the bulk powder 7 remaining in the hopper 1 slowly moves progressively laterally to one side of the hopper 1. This can occur to such an extent that when only a small amount of powder 7 remains in the hopper 1, the powder 7 will not cover all of the holes 5 in the plate 4.

This can lead to the technical problems of an increase in the dispense time or spillage of powder, even if the hopper is frusto-conical with the smaller lower end being provided with the sieve.

The present invention aims to overcome these problems of the known apparatus and method.

GB-A-2360950 discloses a feed assembly for a particular material comprising an apertured screen positioned in a delivery passage, through which material to be delivered passes, and means for hitting screen to assist in the flow of material. The hitting means is centrally disposed in the delivery passage located downstream, with respect to material flow, of the screen. Therefore the hitting means impacts a central part of the screen. The hitting means can move upwardly to repeatedly strike the screen and may comprise a slidable element supported on a cross-member structure or a magnetizable ball movable by means of an electric coil around the delivery passage. The feed assembly is used to deliver material by gravity to a vibra-feeder device and it is disclosed that the material to be dispensed may be toxic material such as plutonium oxide.

The feed assembly disclosed would suffer from problems when employed to dispense very fine powders, such as medicaments, using a precision metering system. This is because the powder may become deposited on the hitting means which is disposed beneath the screen and past which the powder is required to pass for delivery onto the vibra-feeder. This would reduce the accuracy of the precision metering of the powder. Moreover, it would be difficult to prevent any contamination of that medicament by material present or trapped on the hitting means.

Accordingly, the present invention provides an apparatus for dispensing small quantities of particles, the apparatus comprising a hopper provided with a sieve at a bottom portion thereof, the hopper in use containing powder to be dispensed therefrom through the sieve, a support for the hopper, the support holding a portion of the hopper so that the hopper can in use be held above a container into which the dispensed powder is to be received, and at least one actuator for delivering impact energy to the hopper for causing powder to be dispensed through the sieve when the hopper receives the impact energy, wherein the at least one actuator is arranged to deliver impact energy to the hopper from different directions and/or at different locations on the hopper.

The present invention also provides a method of dispensing small quantities of particles, the method comprising the steps of: disposing in a hopper provided with a sieve at a bottom portion thereof a powder to be dispensed therefrom through the sieve; supporting the hopper by holding a portion of the hopper with a support so that the hopper is held above a container into which the dispensed powder is to be received; and delivering impact energy to the hopper by at least one actuator thereby to cause powder to be dispensed through the sieve when the hopper receives the impact energy, the at least one actuator being arranged to deliver impact energy to the hopper from different directions and/or at different locations on the hopper.

This invention accordingly provides the advantage that lateral movement of the bulk powder material in the hopper is substantially prevented such that the uppermost surface of the powder remains substantially horizontal throughout the dispensing of the powder through the sieve.

In one embodiment of the invention, the excitation motion, achieved through the impact energy of a tap, is implemented equally in opposing or differing directions but separated in time. For example, tapping the hopper twice with the same force at the same position of the hopper using a common tapping device can achieve this excitation motion if the second tap is in the opposite direction to the first tap. Alternatively, tapping from other positions around the hopper by using a plurality of tapping devices can achieve the same technical effect.

In another embodiment of the invention, the excitation motion is successively implemented at different positions of the hopper by relative rotation of a tapping device and the hopper between successive taps from the tapping device.

This invention accordingly provides the advantage that lateral movement of the bulk powder material in the hopper is substantially prevented such that the uppermost surface of the powder remains substantially horizontal throughout the dispensing of the powder through the sieve.

The present invention is predicated on the discovery by the inventors that the lateral movement of the bulk powder across the hopper can be substantially eliminated if it is ensured that the summation of a large number of taps has no cumulative force or motion component laterally across the hopper.

Embodiments of the present invention will now be described by way of example only with reference to the accompanying drawings, in which:—

Figure 4:
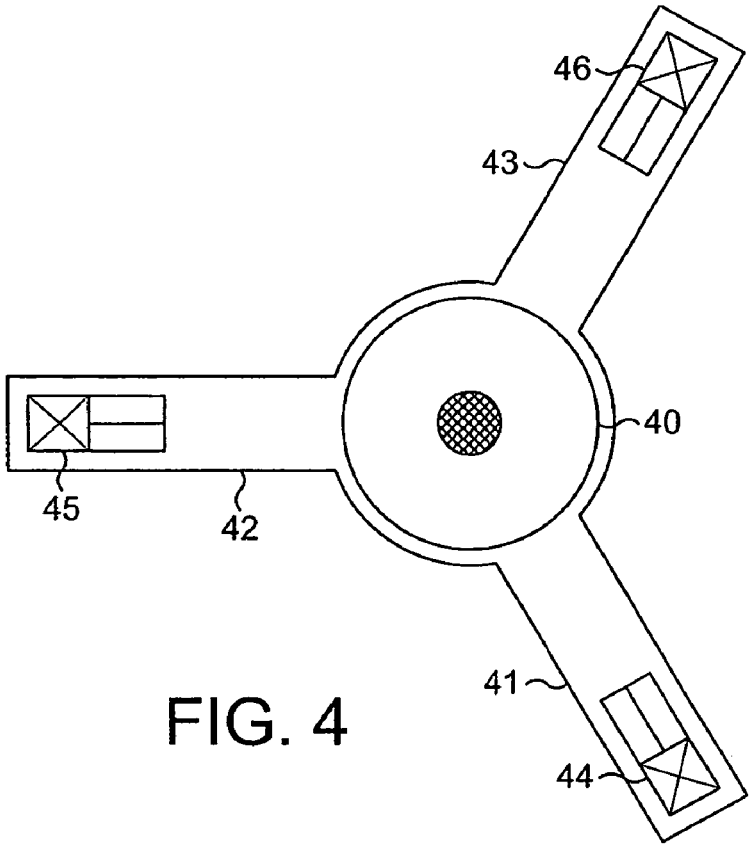
Figure 5:
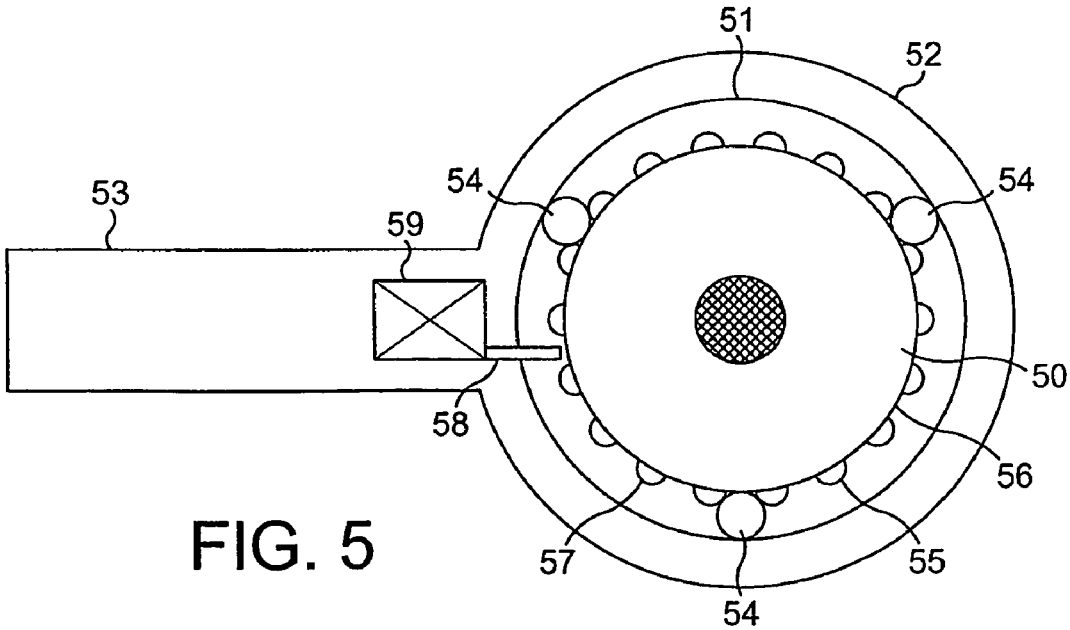

FIG. 4 is a schematic plan view of a hopper and a plurality of tapping devices of a powder dispensing apparatus in accordance with a second embodiment of the present invention for dispensing powder into a receptacle; and FIG. 5 is a schematic plan view of a hopper and a tapping device of a powder dispensing apparatus in accordance with a third embodiment of the present invention for dispensing powder into a receptacle.

Figure 1:
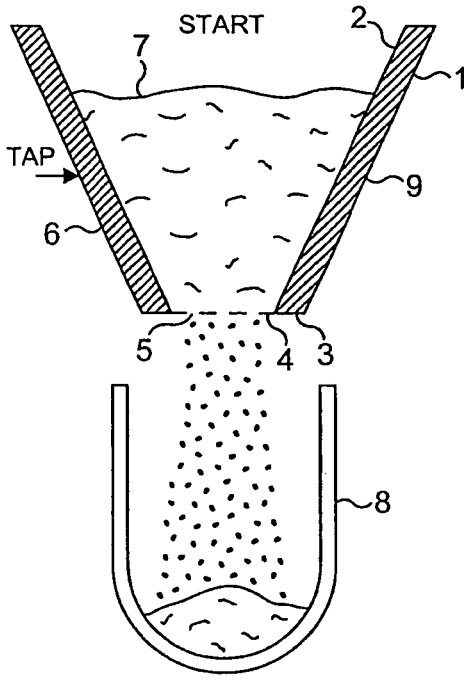
FIG. 1 is a schematic section, from one side, through a hopper of a known powder dispensing apparatus for dispensing powder into a receptacle.
Figure 2:
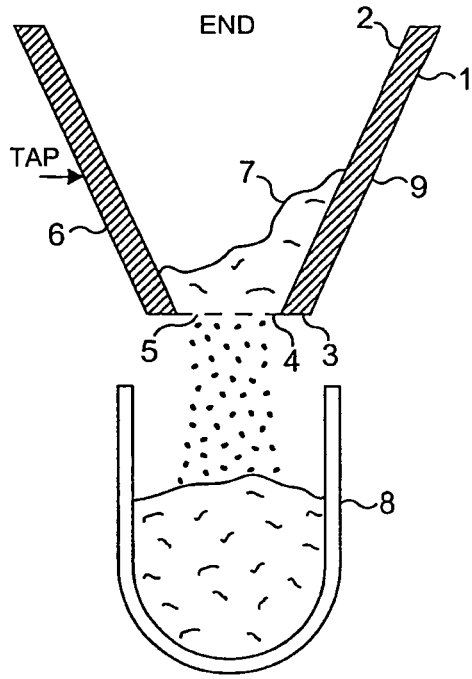
FIG. 2 is a schematic section, from one side, through the hopper and receptacle of FIG. 1 showing the problem of lateral movement of bulk powder in the hopper.
Figure 3:
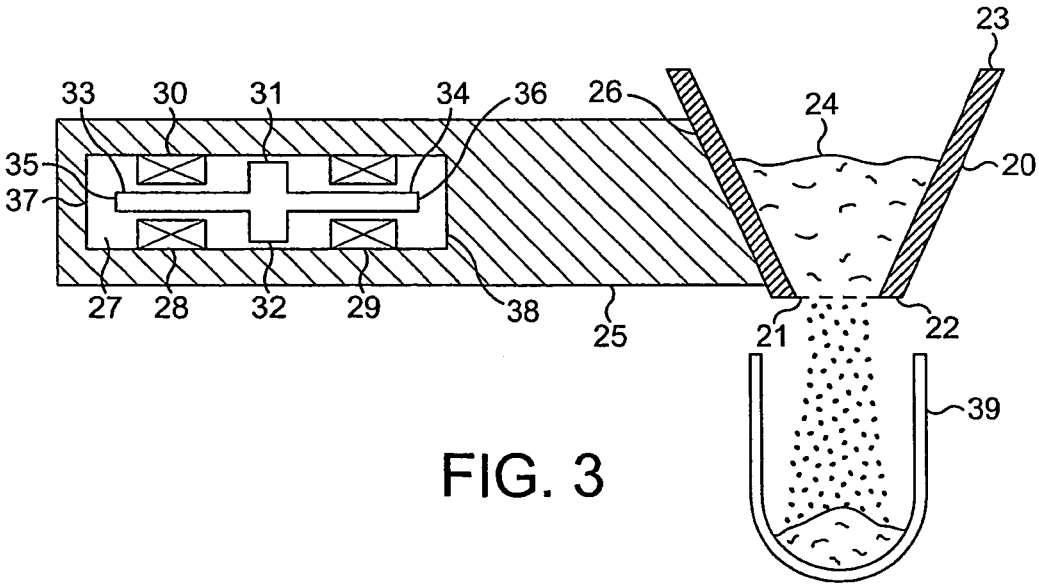
FIG. 3 is a schematic section, from one side, through a hopper and a tapping device of a powder dispensing apparatus in accordance with a first embodiment of the present invention for dispensing powder into a receptacle.

FIG. 3 shows a hopper and a tapping device of a powder dispensing apparatus in accordance with a first embodiment of the present invention for dispensing powder into a receptacle. In this embodiment, a frusto-conical hopper 20 has a sieve 21 at its smaller lower end 22 and a larger upper end 23 for receiving bulk powder 24, such as medicament, to be dispensed through the sieve 21. The hopper 20 is supported by a cantilever arm 25, which is attached to or bears against a sidewall 26 of the hopper 20. Within the cantilever arm 25 is provided a longitudinally directed cavity 27, and in the cavity 27 are disposed, in a longitudinally mutually spaced configuration, a pair of longitudinally oriented first and second solenoid coils 28,29 of a solenoid 30, comprising an electromechanical actuator. The coils 28,29 are rigidly attached to the cantilever arm 25. An armature 31 of the solenoid 30 comprises a longitudinally extended body having a central bush 32 and two opposed first and second projecting portions 33,34, each of the projecting portions 33, 34 extending within a respective one of the coils 28,29, and with the bush 32 centrally disposed between the two coils 28,29. If desired, a pair of opposed helical compression springs (not shown) may be provided, with each spring located between the bush 32 and a respective coil 28,29, thereby to urge the armature 31 into a central position in the absence of any actuating force on the armature 31. The first and second projecting portions 33,34 have respective first and second end walls 35,36 which are each spaced from a respective first and second end face 37,38 of the cavity 27 when the armature 31 is in the central position.

When a first current pulse is passed through the first coil 28, the armature 31 is accelerated towards the second end face 38 of the cavity 27 and the end wall 36 impacts it. The impact momentum is transferred by the cantilever arm 25 to the hopper 20 and the bulk powder 24 therein and causes a discrete amount of the powder 24 to fall into a receptacle 39 located, in use, beneath the sieve 21 of the hopper 20. Thereafter, when a second current pulse is passed through the second coil 28, the armature 31 is accelerated towards the first end face 37 of the cavity 27 and the end wall 35 impacts it. The impact momentum is again transferred by the cantilever arm 25 to the hopper 20 and the bulk powder 24 therein and causes a discrete amount of the powder 24 to fall into the receptacle 39. Accordingly, alternate energising of the two coils 28,29 causes the armature 31 to move in opposite directions in an alternating manner.

With this arrangement it is possible to tap the hopper 20 in either direction along the cantilever arm 25. Accordingly, powder dispensing may occur either by alternating the direction of tapping in successive tapping steps corresponding to successive powder dispense actions or alternatively by always using a pair of taps closely separated in time in a single tapping step to achieve a single powder dispense action.

The use of a solenoid 30 to generate the impact on the hopper 20 and the bulk powder 24 therein allows the magnitude of the impact to be altered by controlling the voltage driving the first and second coils 28,29 of the solenoid 30. Thus even if the mechanical arrangement causes some difference between the magnitude or effect of the forward and reverse taps associated with the energisation of the two coils 28,29, the overall cumulative effect can be balanced by using different forward and reverse drive voltages. The same effect can be achieved by changing the pulse width, i.e. the period of time during which each coil 28,29 is switched on.

In other embodiments of the invention, it may be advantageous in some instances to use a different actuator arrangement to stimulate powder flow and as such the means of averaging the direction of excitation would be altered for optimal performance with that arrangement.

Accordingly, a hopper and a plurality of tapping devices of a powder dispensing apparatus in accordance with a second embodiment of the present invention for dispensing powder into a receptacle is shown in FIG. 4.

In this embodiment, the hopper 40 is supported by a plurality of arms, in the illustrated embodiment three arms 41, 42 and 43 arranged at 120 degrees to each other and with the hopper 40 located and supported at the radial centre of the arms 41,42,43. Each arm 41,42 43 has a respective solenoid 44,45,46 mounted in it. Each solenoid may be a single direction acting solenoid, or alternatively a double direction acting solenoid as described with reference to the first embodiment.

In the three arm illustrated embodiment, each arm only needs a single direction acting solenoid which has a modified structure as compared to the double direction action solenoid of the embodiment of FIG. 3. In the single direction acting solenoid, only one coil is provided and a helical compression spring is provided to bias the end wall of the projecting portion remote from the coil away from the adjacent end face of the cavity in the arm. The armature is moved against the bias of the spring to cause a tap of the end wall against the end face of the cavity by energising of the coil. After the current pulse has terminated, the spring bias returns the armature back to its original position.

Such an arrangement of plural arms, each with a respective solenoid actuator, enables tilt of the powder in any direction to be compensated for by control of the number and amplitude of the taps from the solenoid associated with each arm. This is of benefit if the hopper axis is not vertical. In contrast, if a tilt of the powder surface orthogonal to a single support arm occurs, this tilt would not be correctable by the provision of a single support arm.

Alternatively where it is preferred to maintain the single direction tap using a single cantilever arm then it may be advantageous to incorporate a means by which the hopper is rotated with respect to the arm as it is tapped. Accordingly, a hopper and a tapping device of a powder dispensing apparatus in accordance with a third embodiment of the present invention for dispensing powder into a receptacle is shown in FIG. 5.

In this embodiment, a hopper 50 is free to rotate in a circular hole 51 defined in an annular portion 52 of a cantilever arm 53 by means of bearings 54 which are provided between the hopper 50 and the annular portion 52. A ratchet mechanism 55 is provided around the annular outer surface 56 of the hopper 50. The ratchet mechanism 55 comprises a plurality of angularly spaced radial projections 57. The projections 57 engage with an armature 58 of an actuating solenoid 59 mounted on the arm 53. The solenoid 59 is a single direction acting solenoid as described hereinabove. Accordingly, when the solenoid 59 is energised it not only delivers the impact energy to dispense the powder through a sieve 60 of the hopper 50 but also rotationally moves the hopper 50 incrementally through an angle defined by the angular separation of the projections 57 of the ratchet mechanism 55.

In this way the direction of impact is averaged over the complete circumference of the hopper 50 once the hopper 50 has completed one revolution. This ensures that the upper surface of the bulk powder in the hopper 50 is substantially level.

Although the actuator comprising the hopper impact mechanism is described in the illustrated embodiments as a solenoid, this is only one possible actuator. Alternative actuators may comprise an electric motor and cam; a piezoelectric actuator; or a voice coil linear actuator. Alternative arrangements can include a vertically directed solenoid or linkage such that the horizontal action of the solenoid causes the hopper to have a vertical as well as a horizontal response to the tapping action.

The invention claimed is:

1. An apparatus comprising a hopper provided with a sieve at a bottom portion thereof, the hopper in use containing powder to be dispensed therefrom through the sieve, a support for the hopper, the support holding a portion of the hopper so that the hopper can in use be held above a container into which the dispensed powder is to be received, and at least one actuator for delivering taps to the hopper for causing a discrete amount of the powder to be dispensed through the sieve when the hopper receives each tap, wherein the at least one actuator is arranged to deliver the taps to the hopper from different directions and/or at different locations on the hopper;

wherein one said actuator is provided which is mounted on the support and is adapted to deliver the taps to the hopper alternately in two opposing directions; and wherein the actuator is a solenoid having an armature which is adapted to impact two opposed parts of the support.

2. An apparatus according to claim 1 wherein the actuator is adapted to cause rotation of the hopper by successive delivery of the taps to the hopper.

3. An apparatus according to claim 1 wherein a plurality of actuators are provided and are mounted at different positions around the hopper so that the hopper receives the taps at a plurality of different locations.

4. An apparatus according to claim 3 wherein each actuator is provided on a respective arm of the support and the actuators are angularly spaced in a radial orientation around the hopper.

5. An apparatus comprising a hopper provided with a sieve at a bottom portion thereof, the hopper in use containing powder to be dispensed therefrom through the sieve, a support for the hopper, the support holding a portion of the hopper so that the hopper can in use be held above a container into which the dispensed powder is to be received, and at least one actuator for delivering impact energy to the hopper for causing a discrete amount of the powder to be dispensed through the sieve when the hopper receives the impact energy, wherein the at least one actuator is arranged to deliver the impact energy to the hopper from different directions and/or at different locations on the hopper;

wherein one said actuator is provided which is mounted on the support and is adapted to cause rotation of the hopper by successive delivery of the impact energy to the hopper.

6. An apparatus according to claim 2 wherein a plurality of actuators are provided and are mounted at different positions around the hopper so that the hopper receives the impact energy at a plurality of different locations.

7. An apparatus according to claim 6 wherein each actuator is provided on a respective arm of the support and the actuators are angularly spaced in a radial orientation around the hopper.

8. An apparatus according to claim 5 wherein the hopper is rotatably mounted in the support via a ratchet mechanism and an impact of the actuator on the hopper causes partial rotation of the hopper by operation of the ratchet mechanism.

9. An apparatus according to claim 8 wherein the ratchet mechanism comprises a plurality of angularly spaced radial projections adapted to engage with the armature.

10. An apparatus according to claim 9 wherein partial rotation of the hopper by operation of the ratchet mechanism occurs incrementally through an angle defined by the angular separation of the projections of the ratchet mechanism.

11. A method comprising the steps of: disposing in a hopper provided with a sieve at a bottom portion thereof a powder to be dispensed therefrom through the sieve; supporting the hopper by holding a portion of the hopper with a support so that the hopper is held above a container into which the dispensed powder is to be received; and delivering taps to the hopper by at least one actuator thereby to cause a discrete amount of the powder to be dispensed through the sieve when the hopper receives each tap, the at least one actuator being arranged to deliver the taps to the hopper from different directions and/or at different locations on the hopper;

wherein one said actuator is provided which is mounted on the support and is adapted to deliver the taps to the hopper alternately in two opposing directions; and wherein the actuator is a solenoid having an armature which is adapted to impact two opposed parts of the support.

12. A method according to claim 11 wherein the actuator is adapted to cause rotation of the hopper by successive delivery of the taps to the hopper.

13. A method according to claim 11 wherein a plurality of actuators are provided and are mounted at different positions around the hopper so that the hopper receives the taps at a plurality of different locations.

14. A method according to claim 13 wherein each actuator is provided on a respective arm of the support and the actuators are angularly spaced in a radial orientation around the hopper.

15. A method comprising the steps of: disposing in a hopper provided with a sieve at a bottom portion thereof a powder to be dispensed therefrom through the sieve; supporting the hopper by holding a portion of the hopper with a support so that the hopper is held above a container into which the dispensed powder is to be received; and delivering impact energy to the hopper by at least one actuator thereby to cause a discrete amount of the powder to be dispensed through the sieve when the hopper receives the impact energy, the at least one actuator being arranged to deliver the impact energy to the hopper from different directions and/or at different locations on the hopper;

wherein one said actuator is provided which is mounted on the support and is adapted to cause rotation of the hopper by successive delivery of the impact energy to the hopper.

16. A method according to claim 15 wherein a plurality of actuators are provided and are mounted at different positions around the hopper so that the hopper receives the impact energy at a plurality of different locations.

17. A method according to claim 16 wherein each actuator is provided on a respective arm of the support and the actuators are angularly spaced in a radial orientation around the hopper.

18. A method according to claim 15 wherein the hopper is rotatably mounted in the support via a ratchet mechanism and an impact of the actuator on the hopper causes partial rotation of the hopper by operation of the ratchet mechanism.

19. A method according to claim 18 wherein the ratchet mechanism comprises a plurality of angularly spaced radial projections adapted to engage with the armature.

20. A method according to claim 19 wherein partial rotation of the hopper by operation of the ratchet mechanism occurs incrementally through an angle defined by the angular separation of the projections of the ratchet mechanism.

* * * * *

UNITED STATES PATENT AND TRADEMARK OFFICE

CERTIFICATE OF CORRECTION

PATENT NO. : 7,712,634 B2
APPLICATION NO. : 10/490686
DATED : May 11, 2010
INVENTOR(S) : Donald Bruce Atherton MacMichael et al.

It is certified that error appears in the above-identified patent and that said Letters Patent is hereby corrected as shown below:

Column 6, Claim 6, Line 37, please delete "2" and insert --5--.

Signed and Sealed this

Twentieth Day of July, 2010

David J. Kappos

David J. Kappos
*Director of the United States Patent and Trademark Office*